US011697783B2

(12) United States Patent
Hobday et al.

(10) Patent No.: US 11,697,783 B2
(45) Date of Patent: Jul. 11, 2023

(54) LUBRICANT COMPOSITION

(71) Applicant: EQUUS UK TOPCO LTD, East Yorkshire (GB)

(72) Inventors: Ian Stuart Hobday, Goole (GB); Aitziber Viadas Cienfuegos, Airmyn (GB); John Eastwood, Stockton-on-Tees (GB)

(73) Assignee: EQUUS UK TOPCO LTD, Goole (GB)

( * ) Notice: Subject to any disclaimer, the term of this patent is extended or adjusted under 35 U.S.C. 154(b) by 0 days.

(21) Appl. No.: 16/305,993

(22) PCT Filed: May 10, 2017

(86) PCT No.: PCT/EP2017/061213
§ 371 (c)(1),
(2) Date: Nov. 30, 2018

(87) PCT Pub. No.: WO2017/207234
PCT Pub. Date: Dec. 7, 2017

(65) Prior Publication Data

US 2019/0144777 A1 May 16, 2019

(30) Foreign Application Priority Data

Jun. 3, 2016 (GB) ..... 1609713

(51) Int. Cl.

| | |
|---|---|
| ***C10M 169/04*** | (2006.01) |
| ***C10M 145/18*** | (2006.01) |
| ***C10M 145/22*** | (2006.01) |
| ***C10M 145/28*** | (2006.01) |
| *C10N 20/02* | (2006.01) |
| *C10N 20/04* | (2006.01) |
| *C10N 30/06* | (2006.01) |
| *C10N 40/04* | (2006.01) |
| *C10N 40/08* | (2006.01) |
| *C10N 40/22* | (2006.01) |
| *C10N 40/25* | (2006.01) |

(52) U.S. Cl.
CPC ..... *C10M 169/041* (2013.01); *C10M 145/18* (2013.01); *C10M 145/22* (2013.01); *C10M 145/28* (2013.01); *C10M 2203/1025* (2013.01); *C10M 2205/0285* (2013.01); *C10M 2207/2835* (2013.01); *C10M 2209/102* (2013.01); *C10M 2209/104* (2013.01); *C10N 2020/02* (2013.01); *C10N 2020/04* (2013.01); *C10N 2030/06* (2013.01); *C10N 2040/04* (2013.01); *C10N 2040/08* (2013.01); *C10N 2040/22* (2013.01); *C10N 2040/25* (2013.01)

(58) Field of Classification Search
CPC ..... C10M 169/041; C10M 145/18; C10M 145/28; C10M 145/22; C10M 2207/2835; C10M 2205/0285; C10M 2209/104; C10M 2209/102; C10M 2203/1025; C10N 2220/022; C10N 2240/401; C10N 2240/10; C10N 2240/08; C10N 2240/04; C10N 2230/06; C10N 2220/021
See application file for complete search history.

(56) References Cited

U.S. PATENT DOCUMENTS

| | | | |
|---|---|---|---|
| 2,430,842 | A | 11/1947 | Young et al. |
| 2011/0067662 | A1 | 3/2011 | Loper |
| 2015/0225686 | A1 | 8/2015 | Bingeman et al. |

FOREIGN PATENT DOCUMENTS

| | | | | |
|---|---|---|---|---|
| CN | 1940037 | A | 4/2007 | |
| EP | 0000424 | A1 | 1/1979 | |
| EP | 2746372 | A1 | 6/2014 | |
| GB | 2002400 | A | 2/1979 | |
| JP | 04320499 | A | 11/1992 | |
| JP | 2002167595 | A | 6/2002 | |
| JP | 2008007544 | A | 1/2008 | |
| JP | 2011513538 | A | 4/2011 | |
| WO | 9855088 | A1 | 12/1998 | |
| WO | 2009108547 | A1 | 9/2009 | |
| WO | 2013154978 | A1 | 10/2013 | |
| WO | WO-2013154978 | A1 * | 10/2013 | ..... C10M 149/14 |
| WO | 2015065801 | A1 | 5/2015 | |
| WO | 2015120418 | A1 | 8/2015 | |

OTHER PUBLICATIONS

International Search Report and Written Opinion for International Application No. PCT/EP2017/061213, dated Jun. 26, 2017—11 pages.
"Atlox (R) Polymeric Surfactants: Agricultural Applications", Technical Bulletin (Uniqema), Apr. 1, 2000, pp. 1-8.
Martin et al., "Maximizing the Stability of Pyrolysis Oil/Diesel Fuel Emulsions", Energy & Fuels, vol. 28, No. 9, Sep. 18, 2014, pp. 5918-5929.
Japanese Notice of Reasons for Refusal for Japanese Application No. 2018-562624, dated Nov. 10, 2020 with translation, 10 pages.

* cited by examiner

*Primary Examiner* — Taiwo Oladapo

(57) ABSTRACT

The present invention provides a non-aqueous lubricant composition comprising a base stock and 5 at least 0.02 wt % of a friction reducing additive which comprises a block co-polymer of at least one block A which is an oligo- or polyester residue of a hydroxycarboxylic acid and at least one block B which is a residue of a polyalkylene glycol. The invention also provides the use of a block co-polymer of at least one block A which is an oligo- or polyester residue of a hydroxycarboxylic acid and at least one block B which is a residue of a polyalkylene glycol to reduce the kinetic co-efficient 10 of friction in a non-aqueous lubricant composition when compared to an equivalent lubricant composition comprising no block co-polymer.

16 Claims, No Drawings

LUBRICANT COMPOSITION

CROSS REFERENCE TO RELATED APPLICATIONS

This application is the National Stage filing of International Appln. No. PCT/EP2017/061213, filed May 10, 2017, and claims priority of GB Application No. 1609713.1, filed Jun. 3, 2016, the entirety of which applications is incorporated herein by reference for all purposes.

The present invention relates to a lubricant composition comprising a base stock and a friction reducing additive. The lubricant composition may be used as an engine oil, a hydraulic oil or fluid, a gear oil and/or a metal-working fluid. The invention also relates to the use of the friction reducing additive and a method of reducing friction.

Friction reducing additives may be used in engine oils, hydraulic oils or fluids, gear oils and metal-working fluids.

Friction reducing additives that have been used to improve fuel economy in automotive engine oils fall into three main chemically-defined categories, which are organic, metal organic and oil insoluble. The organic friction-reducing additives themselves fall within four main categories which are carboxylic acids or their derivatives, nitrogen-containing compounds such as amides, imides, amines and their derivatives, phosphoric or phosphonic acid derivatives and organic polymers. In current commercial practice, examples of friction reducing additives are glycerol monooleate and oleylamide, which are both derived from unsaturated fatty acids.

Automotive engine oils typically comprise a lubricant base stock and an additive package, both of which can contribute significantly to the properties and performance of the automotive engine oil.

The choice of lubricant base stock can have a major impact on properties such as oxidation and thermal stability, volatility, low temperature fluidity, solvency of additives, contaminants and degradation products, and traction. The American Petroleum Institute (API) currently defines five groups of lubricant base stocks (API Publication 1509).

Groups I, II and III are mineral oils which are classified by the amount of saturates and sulphur they contain and by their viscosity indices. Table One below illustrates these API classifications for Groups I, II and III.

TABLE ONE

| Group | Saturates | Sulphur | Viscosity Index (VI) |
|---|---|---|---|
| I | <90% | >0.03% | 80-120 |
| II | At least 90% | Not more than 0.03% | 80-120 |
| III | At least 90% | Not more than 0.03% | At least 120 |

Group I base stocks are solvent refined mineral oils, which are the least expensive base stock to produce, and currently account for the majority of base stock sales. They provide satisfactory oxidation stability, volatility, low temperature performance and traction properties and have very good solvency for additives and contaminants. Group II base stocks are mostly hydroprocessed mineral oils, which typically provide improved volatility and oxidation stability as compared to Group I base stocks. The use of Group II stocks has grown to about 30% of the US market. Group III base stocks are severely hydroprocessed mineral oils or they can be produced via wax or paraffin isomerisation. They are known to have better oxidation stability and volatility than Group I and II base stocks but have a limited range of commercially available viscosities.

Group IV base stocks differ from Groups I to III in that they are synthetic base stocks e.g. polyalphaolefins (PAOs). PAOs have good oxidative stability, volatility and low pour points. Disadvantages include moderate solubility of polar additives, for example antiwear additives.

Group V base stocks are all base stocks that are not included in the other Groups. Examples include alkyl naphthalenes, alkyl aromatics, vegetable oils, esters (including polyol esters, diesters and monoesters), polycarbonates, silicone oils and polyalkylene glycols.

To create a suitable lubricant composition, additives are blended into the chosen base stock. The additives either enhance the stability of the lubricant base stock or provide additional protection to the engine. Examples of lubricant additives include antioxidants, antiwear agents, detergents, dispersants, viscosity index improvers, defoamers, pour point depressants and friction reducing additives.

One area of concern for automotive engines is around reduction of fuel consumption and increasing energy efficiency. It is well known that the automotive engine oil has a significant part to play in the overall energy consumption of automotive engines. Automotive engines can be thought of as consisting of three discreet but connected mechanical assemblies which together make up the engine, the valve train, the piston assembly, and the bearings. Energy losses in mechanical components can be analysed according to the nature of the friction regime after the well-known Stribeck curve. Predominant losses in the valve train are boundary and elastohydrodynamic, in the bearings are hydrodynamic, and the pistons hydrodynamic and boundary. Hydrodynamic losses have been gradually improved by the reduction of automotive engine oil viscosity. Elastohydrodynamic losses can be improved by selection of the base stock type, taking into account the traction coefficient of the base stock. Boundary losses can be improved by careful selection of a friction reducing additive.

The present invention seeks to improve the performance of a lubricant composition by including a friction reducing additive which is a block co-polymer which has a surprising friction reducing effect in the lubricant composition.

Thus viewed from one aspect the present invention provides a non-aqueous lubricant composition comprising:

a base stock; and at least 0.02 wt % of a friction reducing additive which comprises a block co-polymer of at least one block A which is an oligo- or polyester residue of a hydroxycarboxylic acid and at least one block B which is a residue of a polyalkylene glycol.

The friction reducing additive advantageously improves the performance of the lubricant composition by reducing friction losses in a system to which the lubricant composition is applied.

The friction reducing additive is preferably used in a lubricant composition selected from automotive engine oils, automotive gear and transmission oils, industrial gear oils, hydraulic oils, compressor oils, turbine oils, cutting oils, rolling oils, drilling oils, and lubricating greases.

In this specification, the term molecular weight will refer to a number average molecular weight where appropriate, e.g. when used with regard to a polymeric species, unless otherwise specified.

As used herein, the terms 'for example,' for instance,' such as,' or 'including' are meant to introduce examples that further clarify more general subject matter. Unless otherwise specified, these examples are provided only as an aid for understanding the applications illustrated in the present disclosure, and are not meant to be limiting in any fashion.

It will be understood that, when describing the number of carbon atoms in a substituent group (e.g. 'C1 to C6 alkyl'), the number refers to the total number of carbon atoms present in the substituent group, including any present in any branched groups. Additionally, when describing the number of carbon atoms in, for example fatty acids, this refers to the total number of carbon atoms including the one at the carboxylic acid, and any present in any branch groups.

It will be understood that any upper or lower quantity or range limit used herein may be independently combined.

As used herein, the term 'HLB' means the hydrophilic/lipophilic balance of a molecule. The HLB value of a molecule is a measure of the degree to which it is hydrophilic or lipophilic, determined by calculating values for the different regions of the molecule. An HLB value of 0 corresponds to a completely lipophilic/hydrophobic molecule, and a value of 20 corresponds to a completely hydrophilic/lipophobic molecule.

The HLB value may be measured experimentally by comparison of the solubility behaviour of the composition being tested with the solubility behaviour of standard compositions of known HLB or may be calculated theoretically, for example by using Griffin's method as is known in the art.

All molecular weights defined herein are number average molecular weights unless otherwise stated. Such molecular weights may be determined by gel permeation chromatography (GPC) using methods well known in the art. The GPC data may be calibrated against a series of linear polystyrene standards.

The friction reducing additive comprises a block co-polymer. The friction reducing additive may further comprise xylene which may be used as a solvent or diluent in the manufacture of the block co-polymer. The friction reducing additive may comprise up to 10 wt % xylene, preferably up to 5 wt % xylene. Alternatively, the friction reducing additive may comprise substantially no xylene i.e. the friction reducing additive may be substantially solvent free. The friction reducing additive may consist essentially of the block co-polymer.

The friction reducing additive may consist of the block co-polymer. The non-aqueous lubricant composition may be substantially free from other friction reducing additives apart from the block co-polymer. The block-copolymer may be the only friction reducing additive which is present in the non-aqueous lubricant composition. The non-aqueous lubricant composition may not comprise a friction reducing additive other than the block co-polymer. The non-aqueous lubricant composition may not comprise a friction reducing additive which is a monoester. The non-aqueous lubricant composition may not comprise a friction reducing additive which is a monoester of a $C_5$ to $C_{30}$ carboxylic acid.

The block co-polymer may have the structure AB. The block co-polymer may have the structure ABA. The block co-polymer may comprise a plurality of A blocks. The block co-polymer may comprise a plurality of B blocks. If the block co-polymer comprises a plurality of A blocks, the A blocks may be the same or different. If the block co-polymer comprises a plurality of B blocks, the B blocks may be the same or different.

Preferably the block co-polymer has the structure AB or ABA wherein the A blocks may be the same or different.

The or each A block may be the residue of a polyester. The polyester may be derived either from one or more hydroxycarboxylic acids, or from a mixture of one or more hydroxycarboxylic acids and one or more carboxylic acids containing no hydroxyl groups. The carboxylic acid containing no hydroxyl groups may act as an end cap.

The or each hydroxycarboxylic acid may contain 12 to 20 carbon atoms. Preferably 8 to 14 carbon atoms are situated between the hydroxyl group and the carboxyl group of the hydroxycarboxylic acid. The hydroxyl group occurring in the hydroxycarboxylic acid is preferably a secondary hydroxyl group. Preferably the hydroxycarboxylic acid is saturated. Preferably the hydroxycarboxylic acid is aliphatic.

Examples of suitable hydroxycarboxylic acids from which the polyesters can be derived are 9-hydroxystearic acid, 10-hydroxystearic acid and 12-hydroxystearic acid.

If the polyester is derived from a mixture of one or more hydroxycarboxylic acids and one or more carboxylic acids containing no hydroxyl groups, the carboxylic acids may contain 8 to 20 carbon atoms. Examples of such carboxylic acids are lauric acid, palmitic acid and stearic acid.

The polyesters may be prepared by heating one or more of the hydroxycarboxylic acids, optionally together with one or more carboxylic acids containing no hydroxyl groups, optionally in the presence of a solvent and/or an esterification catalyst, preferably at a temperature between 100 and 250° C. Examples of suitable mixtures of carboxylic acids which may be used as starting material in the preparation of the polyesters are mixtures of 9-hydroxystearic acid and 10-hydroxystearic acid, mixtures of 12-hydroxystearic acid and stearic acid, mixtures of 12-hydroxystearic acid with palmitic acid and stearic acid.

The or each A block may be prepared by reaction of a hydroxycarboxylic acid on to the B block. Alternatively, the or each A block may be prepared as a separate oligomer or polymer and then added to the B block.

Preferably the polyesters are derived from 12-hydroxystearic acid or from a mixture of carboxylic acids substantially consisting of 12-hydroxycarboxylic acids. The or each A block may be a poly-hydroxystearate block.

Preferably the hydroxycarboxylic acid is a hydroxystearic acid.

The or each A block may comprise at least 2 repeat units, preferably at least 4 repeat units. The or each A block may comprise up to 10 repeat units, preferably up to 8 repeat units. Preferably the or each A block comprises about 6 repeat units.

The number of repeat units will not normally have the same unique value for all of the A blocks in the co-polymer but will be statistically distributed about an average value lying within the range stated, as is commonplace in polymeric materials.

The repeat units may be hydroxystearic acid residues. Preferably the repeat units are 12-hydroxystearic acid residues.

The or each A block may have a molecular weight of at least 500, preferably at least 1000. The or each A block may have a molecular weight of up to 3000, preferably up to 2000.

The A block is typically made up of repeat units of the formula:

$$—O—CH—[(CH_2)_a.CH_3].(CH_2)_b.CO—$$

where a is typically from 3 to 8 and b is typically from 8 to 12 and a+b is typically from 11 to 17 (corresponding to overall carbon chain lengths in the precursor acid of 14 to 20). The repeat units in the blocks A are particularly desirably of 12-hydoxystearic acid i.e. where a is 5 and b is 10.

Desirably, the number of fatty acid residues in each block A residues is on average from 3 to 10 (900 to 3000 Da), particularly from about 4 to about 8 (about 1200 to about 2400 Da) and especially about 5 to about 7 (about 1500 to 2100 Da).

Preferably the molecular weight of the polymeric block A is in the range 1000 to 2500.

In practice, such acids are commercially available as mixtures of the hydroxycarboxylic acid and the corresponding unsubstituted fatty acid. Thus, 12-hydroxystearic acid is typically manufactured by hydrogenation of castor oil fatty acids including the C18 unsaturated hydroxycarboxylic acid and the non-substituted unsaturated fatty acids (oleic and linoieic acids) which on hydrogenation gives a mixture of 12-hydroxystearic and stearic acids. During manufacture of the polyester chains, the presence of the unsubstituted acid acts to limit the chain length of the oligomer or polymer. Therefore the or each polymeric A block may be end capped with a carboxylic acid, for example stearic acid.

Hydroxystearic acid is available containing about 15% unsubstituted stearic acid and this on polymerisation gives an average chain length of about 5 to 7 hydroxystearate residues terminated by a stearic acid residue.

The polyalkylene glycol, from which the or each B block may be derived by the notional removal of the two terminal hydroxyl groups, may be a polyethylene glycol, a polypropylene glycol, a mixed poly(ethylene-propylene) glycol or a mixed poly (ethylene-butylene) glycol.

Preferably the polyalkylene glycol is a polyethylene glycol

The polyalkylene glycol may have a molecular weight of at least 400, preferably at least 1000. The polyalkylene glycol may have a molecular weight of up to 6000, preferably up to 5000, more preferably up to 4500.

Preferably the molecular weight of the polymeric block B is in the range 400 to 4600.

The polyalkylene glycol may comprise a mixture of polyalkylene glycols of different chain lengths. A first polyalkylene glycol in the mixture may have a molecular weight between 1000 and 2000 and a second polyalkylene glycol may have a molecular weight between 3000 and 5000. The first polyalkylene glycol may be present at 20 to 40 wt % of the mixture and the second polyalkylene glycol may be present at 60 to 80 wt % of the mixture.

Preferably the or each A block is a poly-hydroxystearate and the or each B block is a polyethylene glycol (PEG).

The block co-polymer may have a number average molecular weight of at least 2000, preferably at least 2500, more preferably at least 3000, especially preferably at least 3200. The block co-polymer may have a number average molecular weight of up to 10,000, preferably up to 7500, more preferably up to 5000, especially preferably up to 4500. The block co-polymer may have a number average molecular weight in the range 2000 to 10,000, preferably from 2500 to 7500, more preferably from 3000 to 5000, especially preferably from 3200 to 4500.

Without wishing to be bound by theory, a block co-polymer with a number average molecular weight as defined above may be of a size which provides a balance between the increased diffusion which may be associated with a smaller size and the increased ability to remain at a surface to reduce friction which may be associated with a larger size. A block co-polymer which has a number average molecular weight of less than 2000 may not be able to remain at the surface to provide friction reduction over a suitable period of time. A block co-polymer which has a number average molecular weight of over 10,000 may not diffuse in the lubricant composition at an acceptable rate.

The number average molecular weight may be measured by Gel Permeation Chromatography, for example as described herein.

The block-copolymer may have an HLB value greater than 6. The block-copolymer may have an HLB value of at least 6.1, preferably at least 6.5, more preferably at least 6.7, even more preferably at least 7. The block co-polymer may have an HLB value of at most 14, preferably at most 12, more preferably at most 10, even more preferably at most 9.5, yet more preferably at most 9. The block-copolymer may have an HLB value of about 8.

An HLB value greater than 6 may advantageously improve the friction reducing effect of the friction reducing additive. An HLB value above 6 may improve the friction reducing effect of the friction reducing additive at higher temperatures, for example at least 80° C., at least 100° C. or at least 150° C. This may be beneficial if the friction reducing additive is used in a hot environment such as an automotive engine.

The lubricant composition comprises a base stock. The lubricant composition may comprise at least 50 wt % of base stock, preferably at least 60 wt % of base stock, more preferably at least 70 wt % of base stock. The lubricant composition may comprise at least 80 wt % of base stock. The lubricant composition may comprise up to 98 wt % of base stock, preferably up to 95 wt % of base stock, more preferably up to 90 wt % base stock.

The lubricant composition comprises at least 0.02 wt % of the friction reducing additive. The lubricant composition may comprise at least 0.05 wt % of the friction reducing additive, preferably at least 0.1 wt %, more preferably at least 0.5 wt %, even more preferably at least 1 wt %. The lubricant composition may comprise at least 5 wt % of the friction reducing additive, or even at least 10 wt %. The lubricant composition may comprise up to 20 wt % of the friction reducing additive, preferably up to 15 wt %.

The lubricant composition is non-aqueous. However, it will be appreciated that components of the lubricant composition may contain small amounts of residual water (moisture) which may therefore be present in the lubricant composition.

The lubricant composition may comprise less than 5% water by weight based on the weight of the composition. More preferably, the composition is substantially water free, i.e. contains less than 2%, less than 1% or preferably less that 0.5% water by weight. Preferably the lubricant composition is substantially anhydrous.

Preferably, the lubricant composition is an engine oil, hydraulic oil or fluid, gear oil or metal working fluid. To adapt the lubricant composition to its intended use, the lubricant composition may further comprise one or more of the following further additives types.

1. Dispersants, for example: alkenyl succinimides, alkenyl succinate esters, alkenyl succinimides modified with other organic compounds, alkenyl succinimides modified by post-treatment with ethylene carbonate or boric acid, pentaerythritols, phenate-salicylates and their post-treated analogs, alkali metal or mixed alkali metal, alkaline earth metal borates, dispersions of hydrated alkali metal borates, dispersions of alkaline-earth metal borates, polyamide ashless dispersants and the like or mixtures of such dispersants.

2. Anti-oxidants: Anti-oxidants reduce the tendency of mineral oils to deteriorate in service which deterioration is evidenced by the products of oxidation such as sludge and varnish-like deposits on the metal surfaces and by an increase in viscosity. Examples of anti-oxidants include phenol type (phenolic) oxidation inhibitors, such as 4,4'- methylene-bis(2,6-di-tert-butylphenol), 4,4'-bis(2,6-di-tert-butylphenol), 4,4'-bis(2-methyl-6-tert-butylphenol), 2,2'-methylene-bis(4-methyl-6-tert-butylphenol), 4,4'-butylidene-bis(3-methyl-6-tert-butylphenol), 4,4'-isopropylidene-bis(2,6-di-tert-butylphenol), 2,2'-methylene-bis(4-methyl-6-nonylphenol), 2,2'-isobutylidene-bis(4,6-dimethylphenol), 2,2'-methylene-bis(4-methyl-6-cyclohexylphenol), 2,6-di-tert-butyl-4-methylphenol, 2,6-di-tert-butyl-4-ethylphenol, 2,6-di-tert-butylphenol, 2,4-dimethyl-6-tert-butylphenol, 2,6-di-tert-1-dimethylamino-p-cresol, 2,6-di-tert-4-(N,N'-dimethylamino-methylphenol), 4,4'-thiobis(2-methyl-6-tert-butylphenol), 2,2'-thiobis(4-methyl-6-tert-butylphenol), bis(3-methyl-4-hydroxy-5-tert-butylbenzyl)-sulfide, and bis(3,5-di-tert-butyl-4-hydroxy-benzyl). Other types of oxidation inhibitors include alkylated diphenylamines (e.g., Irganox L-57 from Ciba-Geigy), metal dithiocarbamate (e.g., zinc dithiocarbamate), and methylenebis(dibutyldithiocarbamate).

3. Antiwear agents: As their name implies, these agents reduce wear of moving metallic parts. Examples of such agents include, but are not limited to, phosphates, phosphites, carbamates, esters, sulfur containing compounds, and molybdenum complexes.

4. Emulsifiers, for example: Linear alcohol ethoxylates, including TERGITOL® 15-S-3 available from the Dow Chemical Company.

5. Demulsifiers, for example: addition products of alkylphenol and ethylene oxide, polyoxyethylene alkyl ethers, and polyoxyethylene sorbitan esters.

6. Extreme pressure agents (EP agents), for example: zinc dialkyldithiophosphate (primary alkyl, secondary alkyl, and aryl type), sulfurized oils, diphenyl sulfide, methyl trichlorostearate, chlorinated naphthalene, fluoroalkylpolysiloxane, and lead naphthenate. A preferred EP agent is zinc dialkyl dithiophosphate (ZnDTP).

7. Multifunctional additives, for example: sulfurized oxymolybdenum dithiocarbamate, sulfurized oxymolybdenum organo phosphorodithioate, oxymolybdenum monoglyceride, oxymolybdenum diethylate amide, amine-molybdenum complex compound, and sulfur-containing molybdenum complex compound.

8. Viscosity index improvers, for example: polymethacrylate polymers, ethylene-propylene copolymers, styrene-isoprene copolymers, hydrogenated styrene-isoprene copolymers, polyisobutylene, and dispersant type viscosity index improvers.

9. Pour point depressants, for example: polymethacrylate polymers.

10. Foam inhibitors, for example: alkyl methacrylate polymers and dimethyl silicone polymers.

The lubricant composition may comprise at least 0.5 wt % of a further additive or a mixture of further additives, preferably at least 1 wt %, more preferably at least 5 wt %. The lubricant composition may comprise up to 30 wt % of a further additive or a mixture of further additives, preferably up to 20 wt %, more preferably up to 10 wt %.

The additive or additives may be available in the form of a commercially available additive pack. Such additive packs vary in composition depending on the required use of the additive pack. A skilled person may select a suitable commercially available additive pack for each of: an engine oil, a gear oil, a hydraulic fluid and a metal working fluid. An example of a suitable additive pack for an engine oil is Hitec 11100 ex. Afton Chemical Corporation, US which is recommended to be used at about 10 wt % of the lubricant composition. An example of a suitable additive pack for a gear oil is Additin RC 9451 ex. Rhein Chemie Rheinau GmbH, Germany which is recommended to be used at between 1.5 to 3.5 wt % of the lubricant composition. An example of a suitable additive pack for a hydraulic oil or fluid is Additin RC 9207 ex. Rhein Chemie Rheinau GmbH, Germany which is recommended to be used at about 0.85 wt % of the lubricant composition. An example of a suitable additive pack for a metal working fluid is Additin RC 9410 ex. Rhein Chemie Rheinau GmbH, Germany which is recommended to be used at between 2 to 7 wt % of the lubricant composition.

In this specification, base stock Group nomenclatures as defined by the American Petroleum Institute will be used. The base stock may be selected based on the intended use of the lubricant composition.

Preferably the base stock is selected from the group consisting of an API Group I, II, III, IV, V base stock or mixtures thereof. If the base stock includes a polyalphaolefin (PAO) from Group IV then the base stock may also include a mineral oil from Group I, II or III or an ester from Group V to improve the solubility of the friction reducing additive in the base stock. The ester from Group V may be present at between 5 to 10 wt % of the lubricant composition to improve the solubility of the friction reducing additive in the base stock. The base stock may be a mixture of Group IV and Group V base stocks or Group IV and Group I, II or III base stocks.

The lubricant composition of the present invention may be adapted to be used as an engine oil.

Preferably the lubricant composition is an engine oil and the friction reducing additive is present in the range 0.1 to 10 wt %.

For an automotive engine oil the term base stock includes both gasoline and diesel (including heavy duty diesel (HD-DEO) engine oils. The base stock may be chosen from any of the Group I to Group V base oils (which includes Group III+gas to liquid) or a mixture thereof. Preferably the base stock has one of Group II, Group III or a Group IV base oil as its major component, especially Group III. By major component it is meant at least 50% by weight of base stock, preferably at least 65%, more preferably at least 75%, especially at least 85%.

The base stock may also comprise as a minor component, preferably less than 30%, more preferably less than 20%, especially less than 10% of any or a mixture of Group III+, IV and/or Group V base stocks which have not been used as the major component in the base stock.

Examples of such Group V base stocks include alkyl naphthalenes, alkyl aromatics, vegetable oils, esters, for example monoesters, diesters and polyol esters, polycarbonates, silicone oils and polyalkylene glycols. More than one type of Group V base stock may be present. Preferred Group V base stocks are esters, particularly polyol esters.

For engine oils, the friction reducing additive may be present at levels of at least 0.2 wt %, preferably at least 0.3 wt %, more preferably at least 0.5 wt % The friction reducing additive may be present at levels of up to 5 wt %, preferably up to 3 wt %, more preferably up to 2 wt %.

The automotive engine oil may also comprise other types of additives of known functionality at levels between 0.1 to 30 wt %, more preferably between 0.5 to 20 wt %, yet more preferably between 1 to 10 wt % of the total weight of the engine oil. These further additives can include detergents, dispersants, oxidation inhibitors, corrosion inhibitors, rust inhibitors, anti-wear additives, foam depressants, pour point depressants, viscosity index improvers and mixtures thereof. Viscosity index improvers may include polyisobutenes, polymethacrylate acid esters, polyacrylate acid esters, diene polymers, polyalkyl styrenes, alkenyl aryl conjugated diene copolymers and polyolefins. Foam depressants may include silicones and organic polymers. Pour point depressants may include polymethacrylates, polyacrylates, polyacrylamides, condensation products of haloparaffin waxes and aromatic compounds, vinyl carboxylate polymers, terpolymers of dialkylfumarates, vinyl esters of fatty acids and alkyl vinyl ethers. Ashless detergents may include carboxylic dispersants, amine dispersants, Mannich dispersants and polymeric dispersants. Antiwear additives may include ZDDP, ashless and ash containing organic phosphorous and organosulphur compounds, boron compounds, and organo-molybdenum compounds. Ash-containing dispersants may include neutral and basic alkaline earth metal salts of an acidic organic compound. Oxidation inhibitors may include hindered phenols and alkyl diphenylamines. Additives may include more than one functionality in a single additive.

For an engine oil, the base stock may range from SAE viscosity grade 0 W to 15 W. The viscosity index is preferably at least 90 and more preferably at least 105. The base stock preferably has a viscosity at 100° C. of 3 to 10 $mm^2/s$, more preferably 4 to 8 $mm^2/s$. The Noack volatility, measured according to ASTM D-5800 is preferably less than 20%, more preferably less than 15%.

The lubricant composition of the present invention may be adapted to be used as a gear oil.

Preferably the lubricant composition is a gear oil and the friction reducing additive is present in the range 0.1 to 10 wt %.

For gear oils, the friction reducing additive may be present at levels of at least 0.2 wt %, preferably at least 0.3 wt %, more preferably at least 0.5 wt % The friction reducing additive may be present at levels of up to 5 wt %, preferably up to 3 wt %, more preferably up to 2 wt %.

The gear oil may have a kinematic viscosity according to an ISO grade. An ISO grade specifies the mid-point kinematic viscosity of a sample at 40° C. in cSt ($mm^2/s$). For example, ISO 100 has a viscosity of about 100 cSt and ISO 1000 has a viscosity of about 1000 cSt. The gear oil may have a viscosity from ISO 10 to ISO 2000, preferably from ISO 68 to ISO 1000.

If the lubricant composition is to be used as a gear oil, it may further comprise one or more additive(s) which may include at least one species of extreme-pressure agent selected from the group consisting of sulfur-based additives and phosphorus-based additives, or at least one species of the extreme-pressure agents and at least one species of additive selected from the group consisting of solubilizing agent, ashless dispersant, pour point depressant, antifoaming agent, antioxidant, rust inhibitor, corrosion inhibitor and friction modifier.

A gear oil according to the invention may comprise one or more of the further additives described herein.

The gear oil may be used in a wind turbine gear-box. A gear-box is typically placed between the rotor of a wind turbine blade assembly and the rotor of a generator. The gear-box may connect a low-speed shaft turned by the wind turbine blade(s) rotor at about 10 to 30 rotations per minute (rpm), to one or more high speed shafts that drive the generator at about 1000 to 2000 rpm, the rotational speed required by most generators to produce electricity. The high torque exerted in the gear-box can generate huge stress on the gears and bearings in the wind turbine. A gear oil according to the present invention may enhance the fatigue life of the gear-box of a wind turbines by reducing the friction between the gears.

Lubricants in wind turbines gearboxes are often subjected to prolonged periods of use between maintenance i.e. long service intervals. Therefore a long lasting lubricant composition with high stability may be required, so as to provide suitable performance over lengthy durations of time.

The lubricant composition of the present invention may be adapted to be used as a hydraulic oil or fluid.

Preferably the lubricant composition is a hydraulic oil or fluid and the friction reducing additive is present in the range 0.1 to 10 wt %.

For hydraulic oils or fluids, the friction reducing additive may be present at levels of at least 0.2 wt %, preferably at least 0.3 wt %, more preferably at least 0.5 wt % The friction reducing additive may be present at levels of up to 5 wt %, preferably up to 3 wt %, more preferably up to 2 wt %.

The hydraulic oil or fluid may have a viscosity from ISO 10 to ISO 100, preferably from ISO 32 to ISO 68.

Hydraulic oils or fluids find use wherever there is a need to transfer pressure from one point to another in a system. Some of the many commercial applications where hydraulic fluids are utilized are in aircraft, braking systems, compressors, machine tools, presses, draw benches, jacks, elevators, die-castings, plastic moldings, welding, coal-mining, tube reducing machines, paper-machine press rolls, calendar stacks, metal working operations, fork lifts, and automobiles.

A hydraulic oil or fluid according to the invention may comprise one or more of the further additives described herein.

The lubricant composition of the present invention may be adapted to be used as a metalworking fluid.

Preferably the lubricant composition is a metal working fluid and the friction reducing additive is present in the range 1 to 20 wt %.

For metal working fluids, the friction reducing additive may be present at levels of at least 2 wt %, preferably at least 3 wt %, more preferably at least 5 wt % The friction reducing additive may be present at levels of up to 15 wt %, preferably up to 10 wt %.

The metal working fluid may have a viscosity of at least ISO 10, preferably at least ISO 100.

Metalworking operations include for example, rolling, forging, hot-pressing, blanking, bending, stamping, drawing, cutting, punching, spinning and the like and generally employ a lubricant to facilitate the operation. Metalworking fluids generally improve these operations in that they can provide films of controlled friction or slip between interacting metal surfaces and thereby reduce the overall power required for the operations, and prevent sticking and decrease wear of dies, cutting bits and the like. Sometimes the lubricant is expected to help transfer heat away from a particular metalworking contact point.

Metal working fluids often comprise a carrier fluid and one or more additives. The carrier fluid imparts some general lubricity to the metal surface and carries/delivers the specialty additives to the metal surfaces. Additionally, the metal working fluid may provide a residual film on the metal part thereby adding a desired property to the metal being processed. The additives can impart a variety of properties including friction reduction beyond hydrodynamic film lubrication, metal corrosion protection, extreme pressure or anti-wear effects. The carrier fluid may be a base stock.

Carrier fluids include various petroleum distillates including American Petroleum Institute Group I to V base stocks. The additives can exist within the carrier fluid in a variety of forms including as dissolved, dispersed in, and partially soluble materials. Some of the metal working fluid may be lost to or deposited on the metal surface during the working process; or may be lost to the environment as spillage, sprays, etc; and may be recyclable if the carrier fluid and additives have not degraded significantly during use. Due to entry of a percentage of the metal working fluid into process goods and industrial process streams, it is desirable if the components to the metal working fluid are eventually biodegradable and pose little risk of bioaccumulation to the environment The metalworking fluid may comprise up to 90 wt % of base stock, more preferably up to 80 wt %.

A metalworking fluid according to the invention may comprise one or more of the further additives described herein. The metalworking fluid may comprise at least 10 wt % of further additives.

The friction reducing additive may reduce the co-efficient of friction of the non-aqueous lubricant composition when measured using a mini traction machine, when compared to an equivalent lubricant composition comprising no friction reducing additive. The co-efficient of friction may be a kinetic co-efficient of friction.

The coefficient of friction may be reduced over the temperature range 0° C. to 200° C., preferably over the range 20° C. to 180° C., more preferably over the range 40° C. to 150° C., even more preferably over the range 100° C. to 150° C..

The coefficient of friction may be reduced when measured at 0.01 m/s and/or at 0.02 m/s.

The coefficient of friction may be reduced by at least 10% when compared to an equivalent lubricant composition comprising no friction reducing additive, preferably reduced by at least 20%, more preferably reduced by at least 30%, especially preferably reduced by at least 40%.

Preferably, the friction reducing additive is operable to reduce the kinetic coefficient of friction of the lubricant composition at 40° C. to 150° C. when measured by a mini-traction machine at 0.01 m/s and 0.02 m/s by at least 20% when compared to an equivalent lubricant composition comprising no friction reducing additive.

Preferably, the friction reducing additive is operable to reduce the kinetic coefficient of friction of the lubricant composition at 100° C. when measured by a mini-traction machine at 0.01 m/s and 0.02 m/s by at least 20%, more preferably at least 30%, even more preferably at least 40% when compared to an equivalent lubricant composition comprising no friction reducing additive.

The friction reducing additive may reduce the amount of torque required to cut a thread in a pre-drilled hole in a metal bar when using the non-aqueous lubricant composition (with the torque measured for example, using a thread tapping machine), when compared to an equivalent lubricant composition comprising no friction reducing additive. The thread tapping machine may be a Microtap II machine supplied by Microtap USA, Inc. The torque required to cut a thread in the metal bar may be reduced by at least 10%. The metal bar may be made of mild steel or aluminium 6061. Preferably the amount of torque required to cut a thread in a pre-drilled hole in a metal bar as measured using a Microtap II thread tapping machine with the non-aqueous lubricant composition is reduced by at least 10% when compared to an equivalent lubricant composition comprising no block co-polymer.

Viewed from a further aspect, the present invention provides a non-aqueous lubricant composition consisting essentially of, preferably consisting of:

a base stock;

at least 0.02 wt % of a friction reducing additive which comprises a block co-polymer of at least one block A which is an oligo- or polyester residue of a hydroxycarboxylic acid and at least one block B which is a residue of a polyalkylene glycol; and at least one further additive.

The friction reducing additive may consist essentially of or be the block co-polymer.

The or each further additive may be selected from the additives mentioned herein. The or each further additive may be non-aqueous.

Viewed from a yet further aspect, the present invention provides the use of a block co-polymer of at least one block A which is an oligo- or polyester residue of a hydroxycarboxylic acid and at least one block B which is a residue of a polyalkylene glycol to reduce the kinetic co-efficient of friction in a non-aqueous lubricant composition when compared to an equivalent lubricant composition comprising no block co-polymer.

The block co-polymer may be as defined herein.

The co-efficient of friction of the non-aqueous lubricant composition may be reduced as defined herein when compared to an equivalent lubricant composition comprising no block co-polymer.

The non-aqueous lubricant composition may be an engine oil. The non-aqueous lubricant composition may be a hydraulic oil or fluid. The non-aqueous lubricant composition may be a gear oil. The non-aqueous lubricant composition may be a metal working fluid.

Viewed from a still further aspect, the present invention provides a method of reducing friction in a system by adding a non-aqueous lubricant composition as defined herein to the system.

All of the features described herein may be combined with any of the above aspects of the invention, in any combination.

EXAMPLES

The present invention will now be described further by way of example only with reference to the following Examples. All parts and percentages are given by weight unless otherwise stated.

It will be understood that all tests and physical properties listed have been determined at atmospheric pressure and room temperature (i.e. about 20° C.), unless otherwise stated herein, or unless otherwise stated in the referenced test methods and procedures.

Example 1

Preparation of Block Co-Polymer I

A flask fitted with a distillation condenser and an overhead stirrer was charged with 73 g of polyethylene glycol with a molecular weight of about 1500 (PEG 1500) and 146 g of PEG 4000. The flask was heated to 85-90° C. with stirring and a nitrogen sparge to keep the reaction mixture under a flow of nitrogen. Next, 450 g of 12-hydroxystearic acid was charged to the flask. Once the 12-hydroxystearic acid had been charged 1.4 g of tetrabutyl titanate (TBT) catalyst was added. The temperature of the reaction mixture was increased to 222° C. and the acid value of the mixture was monitored every hour. Once the acid value reached 10 mgKOH/g or below, the reaction was stopped. The reaction product was a block co-polymer of polyhydroxystearate (A)—polyethylene glycol (B)—polyhydroxystearate (A).

The block co-polymer had an HLB value of about 8 as measured experimentally by comparison of its solubility in water against compositions of known HLB.

The block co-polymer produced by this Example will be referred to as Block Co-polymer I. The number average molecular weight of Block Co-polymer I was determined using Gel Permeation Chromatography (GPC) as follows.

Samples of Block Co-polymer I were prepared at a concentration of approximately 10 mg/ml using THF as a solvent. Approximately 100 mg of sample was dissolved in 10 ml eluent. The solution was left for 24 hours at room temperature to fully dissolve and then filtered through a 0.2 μm PTFE filter prior to injection into the GPC column. The samples were analysed using the conditions listed below. The samples were injected using automatic sample injection. Data capture and subsequent data analysis was carried out using Viscotek's 'Omnisec' software. Each sample was injected in duplicate.

| | |
|---|---|
| Instrument | Viscotek GPC Max |
| Columns | 3*30 cm Plgel 100A, 1000A & 10,000 GPC columns |
| Eluent | THF + 1% TEA |
| Flow rate | 0.8 ml/min |
| Detection | RI (refractive index) |
| Temperature | 40° C. |

The GPC system was calibrated using a conventional method of calibration against a series of linear polystyrene standards. These standards covered the range from approximately 150 to 450,000 daltons. The GPC columns selected for this analysis have a linear response up to approximately 600,000 daltons.

The number average molecular weight measured as above for Block Co-polymer I was in the range 3,500 to 4,100, with an average value of about 3825.

Example 2

Preparation of Block Co-Polymer II

A flask fitted with a distillation condenser and an overhead stirrer was charged with 219 g of PEG 1500 and heated to 85-90° C. with stirring and a nitrogen sparge. Next, 450 g of 12-hydroxystearic acid was charged to the flask. Once the 12-hydroxystearic acid had been charged, 1.4 g of TBT (tetrabutyl titanate) catalyst was added. The temperature of the reaction mixture was increased to 222° C. and the acid value of the mixture was monitored every hour. Once the acid value reached 10 mgKOH/g or below, the reaction was stopped. The reaction product was a block co-polymer of polyhydroxystearate (A)—polyethylene glycol (B)—polyhydroxystearate (A). The polyhydroxystearate residues each contain about 6 acid residues, corresponding to a molecular weight for each A block of about 1800. The block co-polymer had an HLB value of about 6 as measured experimentally by comparison of its solubility in water against compositions of known HLB.

The block co-polymer produced by this Example will be referred to as Block Co-polymer II. The number average molecular weight of Block Co-polymer II was determined using Gel Permeation Chromatography (GPC) as described above for Example 1.

The number average molecular weight measured for Block Co-polymer II was in the range 3,700 to 3900, with an average value of about 3775.

Example 3

Assessment of the Reduction of the Co-Efficient of Friction in an Engine Oil by Block Co-Polymer I The coefficient of friction of an automotive engine oil lubricant composition (with no friction reducing additive) comprising 92 wt % of a Group IV base stock (Durasyn 166 polyalphaolefin ex INEOS) and 8 wt % of a Group V base stock (Priolube 3970 ester ex Croda) was determined at 100° C. and 150° C. using a Mini Traction Machine (MTM) with a ¾ inch ball on a smooth disc.

The MTM was supplied by PCS Instruments of London, UK. The disc was AISI 52100 hardened bearing steel with a mirror finish (Ra<0.01 μm) and the ball was AISI 52100 hardened bearing steel. The load applied was 36N (1 GPa contact pressure) and the speed of rotation was from 0.01 to 0.05 m/s. The MTM provides a method of defining the Stribeck curve of a given lubricant. The Stribeck curve is a plot of friction in relation to viscosity, speed and load. The MTM is a computer controlled precision traction measurement system. The test specimens and configuration have been designed such that realistic pressures, temperatures and speeds can be attained without requiring very large loads, motors or structures. In the configuration used in this Example, the test specimens are a 19.05 mm (¾ inch) steel ball and a 46 mm diameter steel disc. Approximately 60 ml of the lubricant composition is then added. The ball is loaded against the face of the disc and the ball and disc are driven independently to create a mixed rolling/sliding contact. The frictional force between the ball and disc is measured by a force transducer. Additional sensors measure the applied load, the lubricant temperature and (optionally) the electrical contact resistance between the specimens and the relative wear between them.

The lubricant composition was heated to 40° C. and then run in for 15 minutes at 0.03 m/s once the temperature is reached. A Stribeck curve plot is achieved by measuring the coefficient of friction with speed (reducing the speed from 2.0 m/s to 0.01 m/s), the Stribeck curve plot is repeated 2 more times. The lubricant composition was then heated to 100° C. and then 150° C. and 3 Stribeck curve plots were completed at each temperature.

The above method was then repeated with the addition of 0.5 wt % of Block Co-polymer I from Example 1 to the lubricant composition. Results at 0.01 m/s and 0.02 m/s from these tests are given in Table 2 below.

For comparison, the results of the addition 0.5 wt % of the known friction reducing additives Glycerol Mono-oleate and Oleylamide to the lubricant composition are also provided. It can be seen that Block Co-polymer I performs better (provides a lower co-efficient of friction) than Glycerol Mono-oleate and Oleylamide.

TABLE 2

Effect of addition of friction reducing additives on co-efficient of friction of Engine Oil

| Speed (m/s) | Friction Reducing Additive Temperature (° C.) | Not present Co-efficient of friction | 0.5 wt % of Block Copolymer I from Example 1 Co-efficient of friction | 0.5 wt % of Block Copolymer II from Example 2 Co-efficient of friction | 0.5 wt % of Glycerol Monooleate (comparative) Co-efficient of friction | 0.5 wt % of Oleylamide (comparative) Co-efficient of friction |
|---|---|---|---|---|---|---|
| 0.01 | 40 | 0.088 | 0.062 | 0.052 | 0.079 | 0.076 |
| 0.02 | 40 | 0.072 | 0.053 | 0.047 | 0.067 | 0.071 |
| 0.01 | 100 | 0.088 | 0.035 | 0.045 | 0.070 | 0.063 |
| 0.02 | 100 | 0.077 | 0.044 | 0.045 | 0.059 | 0.065 |
| 0.01 | 150 | 0.097 | 0.035 | 0.052 | 0.043 | 0.069 |
| 0.02 | 150 | 0.089 | 0.031 | 0.054 | 0.036 | 0.063 |

It can be seen from Table 2 that at 40° C., the addition of 0.5 wt % of Block Co-polymer I reduces the co-efficient of friction by about 30% (0.062 compared to 0.088) at 0.01 m/s and by about 26% at 0.02 m/s when compared to a lubricant composition without Block Co-polymer I. At 100° C., the addition of 0.5 wt % of Block Co-polymer I reduces the co-efficient of friction by about 50% at 0.01 m/s and by about 55% at 0.02 m/s. At 150° C., the addition of 0.5 wt % of Block Co-polymer I reduces the co-efficient of friction by about 64% at 0.01 m/s and by about 65% at 0.02 m/s.

The addition of 0.5 wt % of Block Co-polymer II also shows a reduction in the co-efficient of friction when compared to the lubricant composition with no friction reducing additive present. It also reduces the co-efficient of friction when compared with Oleylamide at 40° C., 100° C. and 150° C. When Block Co-polymer II is compared with Block Co-polymer I, it can be seen that the friction reduction provided by Block Co-polymer II is greater at 40° C. but that the friction reduction provided by Block Co-polymer I is greater at 100° C. and 150° C. Without being bound by theory, it is believed that the HLB value of Block Co-polymer I (about 8) may be related to its improved performance at 100° C. and 150° C. when compared with the HLB value of Block Co-polymer II (HLB of about 6).

Example 4

Assessment of the Reduction of the Co-Efficient of Friction in a Hydraulic Fluid by Block Co-Polymer I The experimental procedure for Example 3 was repeated for a hydraulic fluid lubricant composition. Hydraulic Fluid Compositions A and B were tested and the results compared.

Hydraulic fluid Composition A comprises 99.15 wt % of a Group II base stock (Catenex T129) and 0.85 wt % of the commercially available additive package Additin RC 9207 ex. Rhein Chemie Rheinau GmbH, Germany.

Composition B comprises an amount of Composition A with 1 wt % of Block Co-polymer I added.

The results of these tests are given in Table 3 below.

TABLE 3

Effect of addition of Block Co-polymer I on co-efficient of friction of Hydraulic Fluid

| Speed (m/s) | Temperature (° C.) | Co-efficient of friction of Hydraulic Fluid composition A (without Block Co-polymer I) | Co-efficient of friction of Hydraulic Fluid composition B (including 1 wt % of Block Co-polymer I from Example 1) | Relative reduction in co-efficient of friction in composition B compared to composition A |
|---|---|---|---|---|
| 0.01 | 100 | 0.099 | 0.040 | 60% |
| 0.02 | 100 | 0.085 | 0.035 | 59% |
| 0.01 | 150 | 0.100 | 0.017 | 83% |
| 0.02 | 150 | 0.093 | 0.013 | 86% |

It can be seen from Table 3 that Block Co-polymer I reduces the co-efficient of friction in composition B under all conditions tested.

Example 5

Assessment of the Reduction of Wear Scar in a Four-Ball Wear Test by the Addition of Block Co-Polymer I The Four-Ball Wear test is a standardised test and is described in ASTM D4172. A Seta-Shell 4 Ball Lubricant Tester available from Stanhope-Seta of Surrey, UK was used to perform the Four-Ball Wear test in accordance with ASTM D4172. In the Four-Ball Wear test, a steel ball is rotated under load against three stationary steel balls in a pot containing the sample lubricant. The diameters of the wear scars that occur on the stationary balls are measured after completion of the test. For a given load, the smaller the wear scar diameter, the better the load-carrying properties of the fluid.

Compositions C and D were tested and the results compared. Composition C was Catenex S321, a Group I base stock available from Shell. Composition D was 5 wt % of Block Co-polymer I added to Composition C and then diluted with Durasyn 162 polyalphaolefin ex IN EOS to have the same viscosity as Composition C so that both C and D comply with ISO 22.

The results are given in Table 4 below

TABLE 4

| reduction in wear scar by Four-Ball test | | |
|---|---|---|
| Wear Scar for Composition C (mm) | Wear Scar for Composition D (mm) | Relative reduction in Wear Scar for Composition D compared with Composition C |
| 0.72 | 0.52 | 28% |

It can be seen from Table 4 that Block Co-polymer I reduces the wear in composition D.

Example 6

Microtap Test of Block Co-Polymer I with Regard to Metal Working Fluids

A Microtap II thread tapping machine supplied by Microtap USA, Inc. is used to measure the tapping torque of metal working fluids. The Microtap II machine cuts threads in pre-drilled holes at a selected set of operating parameters. Tests were performed on 50 mm×200 mm×8 mm metal bars containing 3.7 mm diameter holes. They were supplied by the company Robert Speck Ltd. Two materials of metal bars were tested: mild steel and Aluminium 6061.

For this Example, the following parameters were used:

1 ml of metal working fluid (lubricant composition) is added to the Microtap II machine using a micro pipette Ambient temperature 6.0 mm depth of hole 4 mm forming tap Maximum torque set at 200 Ncm Cutting speed 1000 rpm After applying the metal working fluid, the holes were threaded and the amount of torque required was recorded.

If a lubricant composition isn't adequate to allow the thread to be formed within the set maximum torque of 200 Ncm then multiple attempts are made by the machine and then declared as a fail.

The results are given in Table 5 below.

TABLE 5

| Micro Tap Test Results | | | |
|---|---|---|---|
| | Catenex S321 (Composition C) | Catenex S321 + 5 wt % Block Co-polymer I (Composition D) | Catenex S321 + 10 wt % Block Co-polymer I (Composition E) |
| Mild Steel-Torque required (Ncm) | Fail (more than 200 Ncm of torque required) | 198 | 180 |
| Aluminium 6061-Torque required (Ncm) | 62 | 39 | 48 |

Using mild steel the reference test of 100 wt % Catenex S321 (Gpl) failed. With the addition of 5 wt % of Block Co-polymer I (viscosity controlled to ISO 22) the torque was 198 Ncm. With the addition of 10 wt % of Block Co-polymer I the torque was 180 Ncm.

Using aluminium 6061 the reference test of 100 wt % Catenex S321 (Gpl) had a torque of 62 Ncm. With the addition of 5 wt % of Block Co-polymer I (viscosity controlled to ISO 22) the torque was 39 Ncm. With the addition of 10 wt % of Block Co-polymer I the torque was 48 Ncm.

Example 7

Reichert Testing of Wear Prevention of Block Co-Polymer I

A Reichert testing machine provided by Anton Parr of Dahlewitz, Germany was used to test wear prevention. In the Reichart testing machine, a rigidly clamped cylinder is pressed against a rotating sliding ring. This involves rotating a roller bearing over a known distance (100 m) with a load of 1.5 kg at ambient temperature. It has to be insured that the fluid flowing into the contact point (friction wear point) between test cylinder and test ring is always sufficient. After testing, abrasive areas (elliptic wear scars) appear on the test cylinder. The dimensions of these wear scars depend on the load-carrying capacity of the test fluid and A/W performance. The higher the load carrying capacity (A/W performance) the smaller the wear scar is after a certain running time or precise distance.

For this example, the following parameters were used:

A hardened steel ring and roll were placed in the Reichert testing machine

The ring was rotated at 1000 rpm

The applied load was 294 N

The ring and roll are cleaned and secured in place. Approximately 25 ml of the lubricant composition is added to the test reservoir. The load is applied and the test is started and run for 100 m sliding distance. The average wear scar area is then calculated.

The wear scar area of the reference Composition C comprising Catenex S321 (Group I) was 35 $mm^2$. Composition E comprising Composition C with the addition of 10 wt % of Block Co-polymer I produced a wear scar area was 25 $mm^2$. Therefore the wear scar area produced by Composition E was reduced by 29% when compared with Composition C.

It is to be understood that the invention is not to be limited to the details of the above embodiments, which are described by way of example only. Many variations are possible.

The invention claimed is:

1. A non-aqueous lubricant composition comprising:

a base stock; and at least 0.5 wt % of a friction reducing additive which comprises a mixture of a first and second block co-polymer, wherein the first and second block co-polymer each comprise at least one block A with a molecular weight in a range of 1000 to 2500 which is an oligo- or polyester residue of a saturated and an aliphatic hydroxycarboxylic acid that is a hydroxystearic acid, the first block co-polymer comprises at least one block B having a molecular weight in a range of 400 to 4600 which is a residue of a polyethylene glycol, and the second block co-polymer comprises at least one block B having a molecular weight in a range of 3000 to 5000 which is a residue of a polyethylene glycol;

wherein the first and second block co-polymer have an ABA structure and the mixture of the first and second block co-polymers has an HUB value of at least 6.5, and wherein the lubricant composition at 40° C. to 150° C. reduces kinetic coefficient of friction by at least 20% when measured by a mini-traction machine at 0.01 m/s and 0.02 m/s when compared with an equivalent lubricant composition which does not comprise the friction reducing additive.

2. A non-aqueous lubricant composition as claimed in claim 1 wherein the number average molecular weight of the mixture of the first and second block co-polymer is in the range 3000 to 5000.

3. A non-aqueous lubricant composition as claimed in claim 1 wherein the base stock is selected from the group consisting; of an API Group I, II, IV, V base oil or mixtures thereof.

4. A non-aqueous lubricant composition as claimed in claim 1 wherein the kinetic coefficient of friction is reduced by at least 40%.

5. A non-aqueous lubricant composition as claimed in claim 1 wherein the lubricant composition is an engine oil, the friction reducing additive is present in the range from 0.5 to 10 wt % and the HLB value of the mixture of the first and second block co-polymer is at least 7.

6. A non-aqueous lubricant composition as claimed in claim 1 wherein the lubricant composition is a hydraulic oil or fluid, the friction reducing additive is present in the range from 0.5 to 10 wt % and the HLB value of the mixture of the first and second block co-polymer is at least 7.

7. A non-aqueous lubricant composition as claimed in claim 1 wherein the lubricant composition is a gear oil, the friction reducing additive is present in the range from 0.5 to 10 wt % and the HLB value of the mixture of the first and second block co-polymer is at least 7.

8. A non-aqueous lubricant composition as claimed in claim 1 wherein the lubricant composition is a metal working fluid and the friction reducing additive is present in the range from 1 to 20 wt %.

9. A non-aqueous lubricant composition consisting essentially of:

a base stock;

at least 0.5% of a friction reducing additive which comprises a mixture of a first and second block co-polymer, wherein the first block co-polymer comprises at least one block A with a molecular weight in a range of 1000 to 2500 which is an oligo- or polyester residue of a saturated and an aliphatic hydroxycarboxylic acid that is a hydroxystearic acid, the first block co-polymer comprises at least one block B having a molecular weight in a range of 400 to 4600 which is a residue of a polyethylene glycol, the second block co-polymer comprises at least one block 13 having a molecular weight in a range of 3000 and 5000 which is a residue of a polyethylene glycol; and wherein the first and second block co-polymer have an ABA structure and the mixture of the first and second block co-polymers has an MB value of at least 6.5, and wherein the lubricant composition at 40° C. to 150° C. reduces kinetic coefficient of friction by at least 20% when measured by a mini-traction machine at 0.01 m/s and 0.02 m/s when compared with an equivalent lubricant composition which does not comprise the friction reducing additive.

10. A method of reducing the kinetic co-efficient of friction in a non-aqueous lubricant composition, the method comprising:

blending a base stock with at least 0.5 wt % of a mixture of a first and second block co-polymer to form a lubricant composition, wherein the first and second block co-polymer each comprise at least one block A with a molecular weight in a range of 1000 to 2500 which is an oligo- or polyester residue of a saturated and an aliphatic hydroxycarboxylic acid that is a hydroxystearic acid, the second block co-polymer comprises at least one block B having a molecular weight in a range of 400 to 4600 which is a residue of a polyethylene glycol, and the second block co-polymer comprises at least one block B having a bolecular weight in a range of 3000 to 5000 which is a residue of a polyethylene glycol;

wherein the first and second block co-polymer have an ABA structure and the mixture of the first and second block co-polymer have an HLB value of at least 6.5, and wherein the lubricant composition at 40° C. to 150° C. reduces kinetic coefficient of friction by at least 20% when measured by a mini-traction machine at 0.01 m/s and 0.02 m/s when compared with an equivalent lubricant composition which does not comprise the mixture of the first and second block co-polymer.

11. The method as claimed in claim 10 wherein the non-aqueous lubricant composition is an engine oil.

12. The method as claimed in claim 10 wherein the non-aqueous lubricant composition is a hydraulic oil or fluid.

13. The method as claimed in claim 10 wherein the non-aqueous lubricant composition is a gear oil.

14. The method as claimed in claim 10 wherein the non-aqueous lubricant composition is a metal working fluid.

15. The method as claimed in claim 14 wherein the amount of torque required to cut a thread in a pre-drilled hole in a metal bar as measured using a Microtap II thread tapping machine with the non-aqueous lubricant composition is reduced by at least 10% when compared to an equivalent lubricant composition which does not comprise the mixture of the first and second block co-polymer.

16. A method of reducing friction in a system comprising adding a non-aqueous lubricant composition as claimed in claim 1 to the system.

* * * * *